US005758229A

United States Patent [19]

Kyung

[11] Patent Number: 5,758,229

[45] Date of Patent: May 26, 1998

[54] METHOD OF CONTROLLING THE CHARGING OPERATION OF THE CONTACT CHARGER OF AN ELECTROPHOTOGRAPHIC APPARATUS TO PREVENT THE CONTACT CHARGER FROM BEING CONTAMINATED

[75] Inventor: Myung-Ho Kyung, Suwon, Rep. of Korea

[73] Assignee: SamSung Electronic Co., Ltd., Suwon, Rep. of Korea

[21] Appl. No.: 814,863

[22] Filed: Mar. 10, 1997

[51] Int. Cl.[6] ..... G03G 21/00; G03G 15/02

[52] U.S. Cl. ..... 399/100; 399/150

[58] Field of Search ..... 399/100, 127, 399/128, 129, 150, 234, 235, 174, 175, 176, 343

[56] References Cited

U.S. PATENT DOCUMENTS

| | | | |
|---|---|---|---|
| 5,034,777 | 7/1991 | Ohzeki et al. . | |
| 5,049,935 | 9/1991 | Saito et al. . | |
| 5,144,368 | 9/1992 | Ohzeki et al. . | |
| 5,148,219 | 9/1992 | Kohyama | 399/150 |
| 5,196,885 | 3/1993 | Takeuchi et al. . | |
| 5,321,471 | 6/1994 | Ito et al. | 399/129 |
| 5,371,578 | 12/1994 | Asano et al. | 399/100 |
| 5,483,323 | 1/1996 | Matsuda et al. . | |
| 5,541,717 | 7/1996 | Saito et al. | 399/150 |
| 5,559,580 | 9/1996 | Niizawa et al. . | |
| 5,568,232 | 10/1996 | Kashihara | 399/175 |
| 5,600,413 | 2/1997 | Kimura . | |

*Primary Examiner*—Joan H. Pendegrass
*Attorney, Agent, or Firm*—Robert E. Bushnell, Esq.

[57] ABSTRACT

A method of controlling the charging operation of the contact charger of an electrophotographic apparatus including a photosensitive drum and a developing means for charging a toner with a negative voltage, the photosensitive drum and developing means being normally supplied with a negative voltage during printing, which includes the steps of: supplying a negative charging voltage of a specified level to the contact charger for a first interval defined as at least one initial rotation of the photosensitive drum in warm-up with the developing means not being supplied with a voltage, cutting off the negative charging voltage, and supplying a negative developing bias voltage which is lower than the surface voltage of the photosensitive drum to the developing means for a second interval defined as the interval before the stopping of the rotation of the photosensitive drum after the first period. Accordingly, negatively charged toner particles scattered by the developing means and abnormally attached to the photosensitive drum are moved from the photosensitive drum to the developing means owing to the electrical potential difference between the surface of the photosensitive drum and the developing means in the first interval, and positively charged ones of the toner particles are moved from the contact charger to the photosensitive drum and then to the developing means owing to the negative developing bias voltage in the second interval.

8 Claims, 2 Drawing Sheets

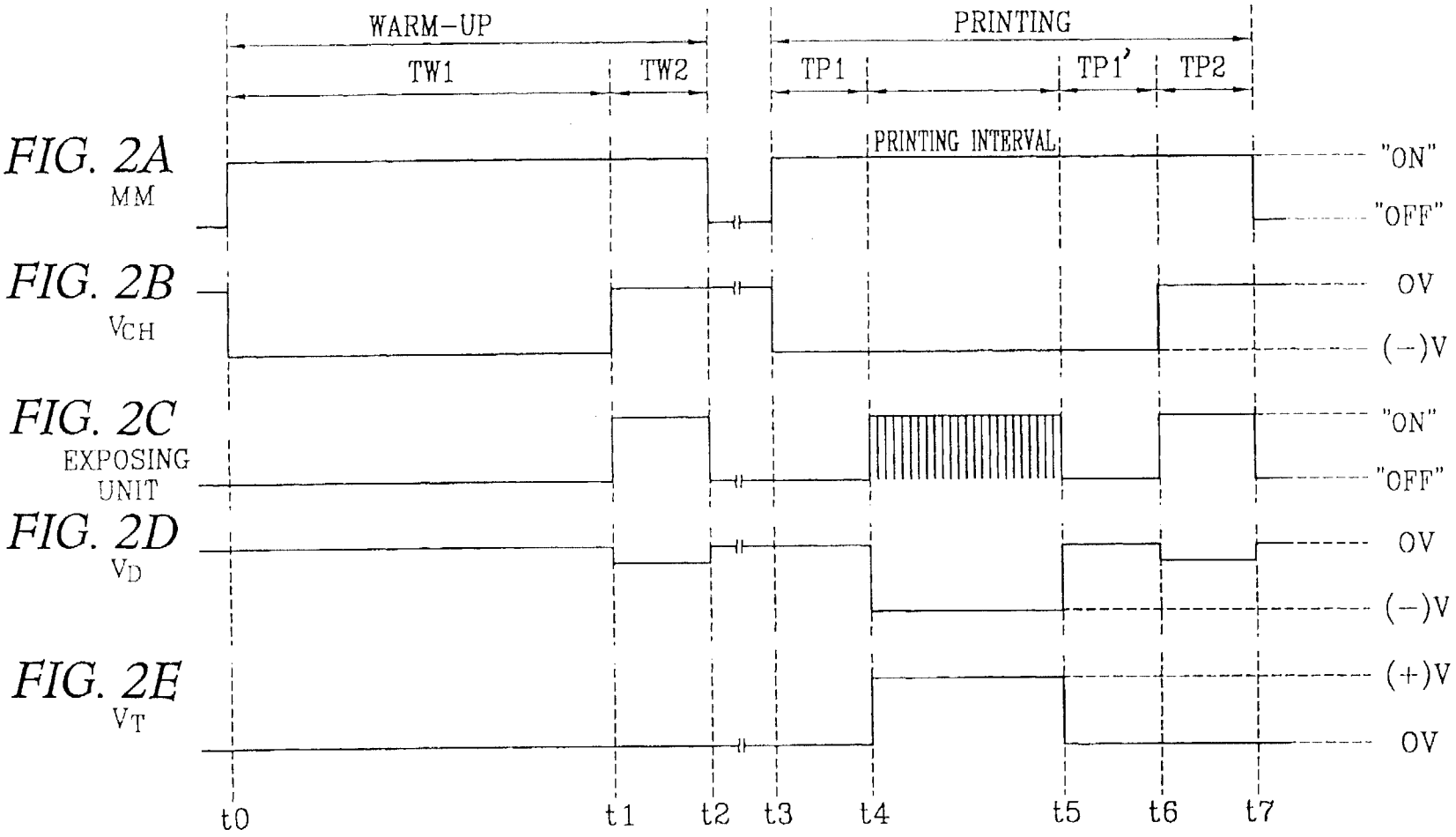
WARM-UP
TW1
TW2
PRINTING
TP1
TP1'
TP2
PRINTING INTERVAL
"ON"
"OFF"
0V
(−)V
"ON"
"OFF"
0V
(−)V
(+)V
0V
t0
t1
t2
t3
t4
t5
t6
t7
FIG. 2A MM
FIG. 2B $V_{CH}$
FIG. 2C EXPOSING UNIT
FIG. 2D $V_D$
FIG. 2E $V_T$

METHOD OF CONTROLLING THE CHARGING OPERATION OF THE CONTACT CHARGER OF AN ELECTROPHOTOGRAPHIC APPARATUS TO PREVENT THE CONTACT CHARGER FROM BEING CONTAMINATED

CROSS-REFERENCE TO RELATED APPLICATION

This application makes reference to, incorporates the same herein, for METHOD FOR CONTROLLING THE CHARGING OPERATION OF THE CONTACT CHARGER OF AN ELECTROPHOTOGRAPHIC APPARATUS TO PREVENT THE CONTACT CHARGER FROM BEING CONTAMINATED earlier filed in the Korean Industrial Property Office on 20 Nov. 1995 and there duly assigned Ser. No. 42254/1995.

BACKGROUND OF THE INVENTION

1. Field of the Invention

The present invention relates to an electrophotographic apparatus, and more particularly to a method of controlling the charging operation of a contact charger of an electrophotographic apparatus to prevent the contact charger from being contaminated.

2. Description of the Related Art

An electrophotographic apparatus produces an image according to a video signal in a copier, laser printer, plain paper facsimile machine, light emitting diode printer, etc. Such an apparatus performs the printing through the steps of charging, exposing, developing, transferring, and fixing.

In an electrophotographic apparatus employing the contact charging method, a conductive roll is used as a contact charger to contact a photosensitive drum so as to be charged with a negative voltage. The photosensitive drum is rotated by a main motor.

In the first step of charging, the surface of the photosensitive drum is uniformly charged with a negative voltage by contacting the conductive roll charged with a negative charging voltage. The printing paper is transferred along a conveyance path by a transfer roll unit from a paper supply cassette to a register roll unit which aligns the leading edge of the paper conveyed to a transferring means.

In the second step of exposing, an exposing unit such as a laser scanner, is used to expose the surface portions of the photosensitive drum corresponding to the configuration of a printed image to form an electrostatic latent image thereon. The exposed portions undergo potential changes but the other portions remain uncharged so as to generate potential differences, which form the latent image.

In the third step of developing the latent image formed on the surface of the photosensitive drum, a developing roll is charged with a negative developing voltage to charge by rubbing a toner supplied from a toner supplier with a negative voltage. A regulation blade regulates the amount of the toner to be uniformly deposited on the developing roll. The negatively charged toner deposited on the developing roll is partly transferred to the exposed surface portions of the photosensitive drum owing to the potential difference therebetween, thus developing the image.

In the fourth step of transferring the developed image of the photosensitive drum to a paper sheet, the transferring means is positively charged with a transferring voltage to attract the negatively charged toner particles deposited on the photosensitive drum to the sheet.

In the fifth step of fixing, the toner particles are fixed on the sheet by being pressed between a pressure roll and heat roll and thereafter, the sheet is discharged.

In such an electrophotographic process, while most of the negatively charged toner particles attached to the photosensitive drum are transferred to the sheet in the transferring step, a portion of them is usually left attached to the photosensitive drum. Additionally, a portion of the toner deposited on the developing roll is scattered and attached to the photosensitive drum. This is one of the causes of contamination of the conductive roll and thus deteriorates the printing quality.

Such toner particles remaining on the photosensitive drum have been removed conventionally by employing an additional cleaning means such as a blade to prevent the conductive roll from being contaminated. Alternatively, there has been proposed a method for producing an electric potential difference between the photosensitive drum and developing roll, whereby the toner particles attached to the photosensitive drum are transferred to the developing roll. Namely, the negative developing bias voltage is cut off in order to make the developing roll have a higher potential than the photosensitive drum while the photosensitive drum is being rotated. Accordingly, the negatively charged toner particles remaining on the photosensitive drum are attached to the developing roll because of the potential difference therebetween.

However, there exists toner particles of positive polarity, namely positively charged toner particles, which are formed by abnormal rubbing with the developing roll or due to the positive transferring voltage. The negatively charged toner particles attached to the photosensitive drum are attracted by the developing roll, but the positively charged toner particles are attracted by and attached to the conductive roll which is charged with the negative charging voltage so that the contaminated conductive roll results in variation of the initially set surface potential of the photosensitive drum, thereby causing a speckled image to occur in the printed paper.

The following patents, while having features in common with the present invention, nevertheless do not teach or suggest the specifically recited method of the present invention: U.S. Pat. No. 5,600,416 to Kimura, entitled *Method And Apparatus For Controlling The Potential Applied To A Contact Charger In An Image Forming Apparatus*, U.S. Pat. No. 5,559,580 to Niizawa et al., entitled *Image Forming Apparatus Having A Bipolar Photosensitive Member*, U.S. Pat. No. 5,483,323 to Matsuda et al., entitled *Electrophotographic Apparatus Utilizing A Hollow Roller Changing Mechanism*, U.S. Pat. No. 5,196,885 to Takeuchi et al., entitled *Image Forming Apparatus*, U.S. Pat. No. 5,144,368 to Ohzeki et al., entitled *Charging Device And Image Forming Apparatus having Same*, U.S. Pat. No. 5,049,935 to Saito et al., entitled *Electrophotographic Image Forming Apparatus With Reversal Development*, and U.S. Pat. No. 5,034,777 to Ohzeki et al., entitled *Transferring Device Having Charging Device With Double Oxide And Voltage Control*.

SUMMARY OF THE INVENTION

It is an object of the present invention to provide a method of controlling the charging operation of a contact charger of an electrophotographic apparatus so as to prevent the contact charger from being contaminated by the toner particles abnormally attached to the photosensitive drum.

According to an embodiment of the present invention, there is provided a method of controlling the charging operation of a contact charger of an electrophotographic apparatus including a photosensitive (photoconductive) drum and a developing means for charging a toner with a negative voltage, the photosensitive drum and developing means being normally supplied with a negative voltage during printing, which comprises the steps of supplying a negative charging voltage of a specified level to the contact charger for a first interval defined as at least one initial rotation of the photosensitive drum during a warm-up interval with the developing means not being supplied with a voltage, cutting off the negative charging voltage, and applying a negative developing bias voltage lower than the surface voltage of the photosensitive drum to the developing means for a second interval defined as the interval before the stopping of the rotation of the photosensitive drum after the first period. Accordingly, negatively charged toner particles scattered by the developing means and abnormally attached to the photosensitive drum are moved from the photosensitive drum to the developing means owing to the electrical potential difference between the surface of the photosensitive drum and the developing means in the first interval, and positively charged toner particles are moved from the contact charger to the photosensitive drum and then to the developing means owing to the negative developing bias voltage in the second interval.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 2A–2E are diagrams illustrating the controlling of the timing of charging according to the present invention.

DETAILED DESCRIPTION OF THE PREFERRED EMBODIMENT

Figure 1:
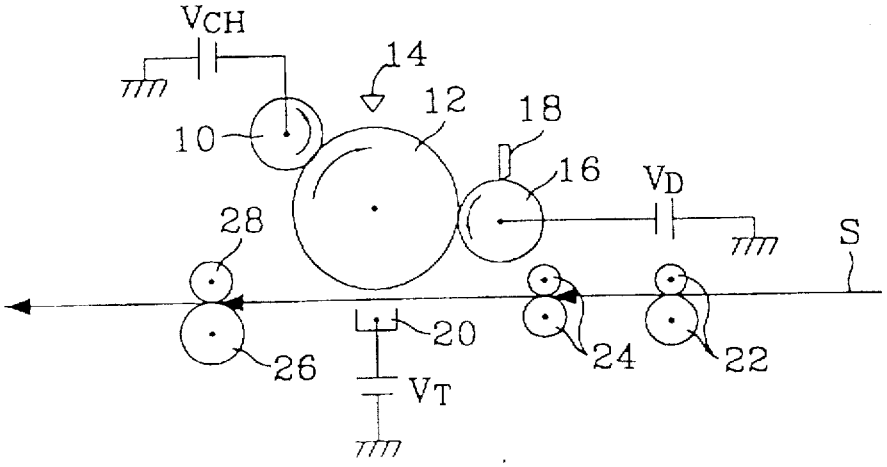
FIG. 1 is a schematic diagram for illustrating the engine mechanism of an electrophotographic processOR.

FIG. 1 illustrates the engine mechanism of an electrophotographic apparatus employing the contact charging method, wherein a conductive roll 10 is used as a contact charger to contact a photosensitive drum so as to be charged with a negative voltage. In the drawing, reference symbol "S" represents the printing conveyance path. A photosensitive drum 12 is rotated by a main motor (not shown) in the direction of the arrow indicated in the drawing. In the first step of charging, the surface of the photosensitive drum 12 is uniformly charged with a negative voltage of about −500V by contacting the conductive roll 10 charged with a negative charging voltage $V_{CH}$. The printing paper is transferred along the conveyance path "S" by a transfer roll unit 22 from a paper supply cassette (not shown) to a register roll unit 24, which aligns the leading edge of the paper conveyed to a transferring means 20.

In the second step of exposing, an exposing unit 14 such as a laser scanner unit (LSU) is used to expose the surface portions of the photosensitive drum 12 corresponding to the configuration of a printed image to form an electrostatic latent image thereon. The exposed portions undergo potential changes but the other portions remain unchanged so as to generate potential differences, which form the latent image.

In the third step of developing the latent image formed on the surface of the photosensitive drum 12, a developing roll 16 is charged with a negative developing voltage $V_D$ of about −450V to charge by rubbing a toner supplied from a toner supplier (not shown) with a negative voltage. In this case, a regulation blade 18 regulates the amount of the toner to be uniformly deposited on the developing roll 16. The negatively charged toner deposited on the developing roll 16 is partly transferred to the exposed surface portions of the photosensitive drum owing to the potential differences therebetween, thus developing the image.

In the fourth step of transferring the developed image of the photosensitive drum 12 to a paper sheet, the transferring means 20 is positively charged with a transferring voltage $V_T$ of about 800V to 1500V to attract the negatively charged toner particles deposited on the photosensitive drum 12 to the sheet.

In the fifth step of fixing, the toner particles are fixed on the sheet by being pressed between a pressure roll 26 and heat roll 28. Thereafter, the sheet is discharged out.

In such an electrophotographic process, while most of the negatively charged toner particles attached to the photosensitive drum 12 are transferred to the sheet in the transferring step, a portion of them is usually left attached to the photosensitive drum 12. Additionally, a portion of the toner deposited on the developing roll 16 is scattered and attached to the photosensitive drum 12. This is one of the causes of contamination of the conductive roll 10 and thus deteriorates the printing quality.

Such toner particles abnormally remaining on the photosensitive drum 12 have been removed conventionally by employing an additional cleaning means such as a blade to prevent the conductive roll 10 from being contaminated. This means may often damage the surface of the photosensitive drum. Instead of using the cleaning means to cope with this drawback, there has been proposed a method for producing an electric potential difference between the photosensitive drum 12 and developing roll 16, whereby the toner particles abnormally attached to the photosensitive drum 12 are transferred to the developing roll 16. Namely, the negative developing bias voltage $V_D$ is cut off in order to make the developing roll 16 have a higher potential than the photosensitive drum 12 while the photosensitive drum 12 is being rotated. Accordingly, the negatively charged toner particles abnormally remaining on the photosensitive drum 12 are attracted by the developing roll 16 because of the potential difference therebetween.

However, there exists toner particles of opposite polarity, namely positively charged toner particles, which are formed by abnormal rubbing with the developing roll 16 or due to the positive transferring voltage $V_T$. Hence, the negatively charged toner particles abnormally attached to the photosensitive drum 12 are attracted by the developing roll 16, but the positively charged toner particles are attracted by and attached to the conductive roll 10 which is charged with the negative charging voltage, so that the contaminated conductive roll 10 results in variation of the initially set surface potential of the photosensitive drum 12. Consequently there appears a speckled image in the printed paper.

Referring to FIGS. 2A–2E, the electrophotographic apparatus warms up for printing in the warm-up interval. The printing is carried out in the printing interval, which represents the time needed for printing a sheet of paper in the present embodiment.

FIG. 2A shows the timing for driving the main motor MM to rotate the photosensitive drum 12, which is rotated in the on-interval and stopped in the off-interval; FIG. 2B shows the timing for charging the conductive roll 10 with a negative charging voltage $V_{CH}$. FIG. 2C shows the timing for turning on/off the exposing unit 14, such as the LSU; FIG. 2D shows the timing for supplying a developing bias voltage $V_D$ to the developing roll 16; and FIG. 2E shows the timing for supplying a transferring voltage $V_T$ to the transferring means 20.

Referring to FIGS. 1 and 2A–2E, the inventive control method will now be described. The general structure and operation of an electrophotographic apparatus is well known in this art, and is therefore not described.

During the warm-up operation, the main motor MM is driven to rotate the photosensitive drum 12 from point t0 to point t2. The charging control timing is divided into first and second intervals TW1 and TW2. The first interval TW1 represents the time taken during the normal warm-up to rotate the photosensitive drum several times, and the second interval TW2 is the time taken for the conductive roll 10 to make at least one complete rotation until stopping the photosensitive drum 12 after the first interval TW1. The second interval TW2 is usually made shorter than the first interval TW1.

In the first interval TW1 from t0 to t1, the conductive roll 10 is supplied with the negative charging voltage $V_{CH}$, the exposing unit 14 is turned off, and the negative developing bias voltage $V_D$ and the positive transferring voltage $V_T$ are cut off. In this case, the surface of the photosensitive drum 12 is charged with a negative voltage by contacting the conductive roll 10. Because the photosensitive drum 12 is rotated in contact with the developing roll 16, negatively charged toner particles abnormally attached to the photosensitive drum 12 are attracted by and attached to the developing roll owing to the potential difference between the photosensitive drum 12 and the developing roll 16. The surface potential of the developing roll 16 is higher than that of the photosensitive drum 12. This is performed during at least one complete rotation of the photosensitive drum 12. Accordingly, all the negatively charged toner particles abnormally attached to the photosensitive drum 12 are removed during the first interval TW1.

In the second interval TW2 from t1 to t2, the negative charging voltage $V_{CH}$ is cut off, the exposing unit 14 is turned on, and the negative developing bias voltage $V_D$ is supplied to the developing roll 16 at a level whose absolute value is lower than that of the normal level. Because the negative charging voltage $V_{CH}$ is not supplied to the conductive roll 10, the remaining positively charged toner particles abnormally attached to the photosensitive drum 12 are not only attracted by the conductive roll 10, but also the positively charged toner particles existing on the conductive roll 10 are transferred to the photosensitive drum 12.

Subsequently, as the photosensitive drum 12 is rotated, it is uniformly exposed to the light of the exposing unit 14 so as to have the surface potential raised. When the photosensitive drum 12 contacts the developing roll 16 charged with the developing bias voltage $V_D$, the positively charged toner particles attached to the photosensitive drum 12 are attracted by and attached to the developing roll 16 owing to the potential difference between the photosensitive drum 12 and the developing roll 16. In this case, the developing bias voltage $V_D$ is supplied so as to be lower than the raised surface potential of the photosensitive drum 12, so that the positively charged toner particles may be attracted by the developing roll 16. This is performed during at least one complete rotation of the photosensitive drum 12 so that the positively charged toner particles not previously removed in the first interval TW1 are removed from the conductive roll 10 and photosensitive drum 12 in the second interval TW2.

The printing operation is started by rotating the main motor MM at t3, and accordingly the photosensitive drum 12 is rotated in the direction as shown by the arrow in FIG. 1 until time point t7. In this case, the timing interval for controlling the charging operation is divided into first intervals TP1 and TP1' and a second interval TP2. The printing is performed in the printing interval from t4 to t5, during which the photosensitive drum 12 is normally rotated several times. The first intervals TP1 and TP1' are defined as a time taken for at least one complete rotation of the photosensitive drum 12 respectively before and after the printing interval. The second interval TP2 is defined as a time taken for at least one complete rotation of the conductive roll 10 until the photosensitive drum 12 is stopped after the first interval TP1'.

The conductive roll 10 is supplied with the negative charging voltage $V_{CH}$ during the time from t3 to t6 including the first intervals TP1 and TP1' and the printing interval. Meanwhile, during the first intervals TP1 of t3 to t4 and TP1' of t5 to t6, the exposing unit 14 is turned off, and the negative developing bias voltage $V_D$ and the positive transferring voltage $V_T$ are cut off, so that an operation corresponding to the operation in the first interval TW1 may be carried out. Namely, the negatively charged toner particles are all removed from the photosensitive drum 12 in the first intervals TP1 and TP1' before and after the printing interval of t4 to t5. In the printing interval, the exposing unit 14 is turned on or off according to the image data of a document while the negative developing bias voltage $V_D$ and positive transferring voltage $V_T$ are respectively supplied to the developing roll 16 and transferring means 20.

In the second interval TP2 of t6 to t7, the negative charging voltage $V_{CH}$ and positive transferring voltage $V_T$ are cut off while the developing roll 16 is supplied with the negative developing bias voltage $V_D$, so that an operation corresponding to the operation in the second interval TW2 may be carried out. Namely, the positively charged toner particles are all removed from the conductive roll 10 and the photosensitive drum 12 in the second interval TP2. Thus, all the negative and positive toner particles are all removed from the photosensitive drum and conductive roll, so that the conductive roll is prevented from being contaminated, thereby improving the printing quality.

While the present embodiment describes the surface potential increase of the photosensitive drum 12 and supplying of the negative developing bias voltage $V_D$ to the developing roll 16 so as to be lower than the increased surface potential level of the photosensitive drum, the same effect may be achieved by supplying the negative developing bias voltage $V_D$ to the developing roll 16 so as to be lower than the surface potential level of the photosensitive drum 12 instead of turning on the exposing unit 14. Namely, since the potential level of the developing roll 16 becomes lower than the surface potential level of the photosensitive drum 12, the positively charged toner particles abnormally attached to the photosensitive drum 12 are attracted by and attached to the developing roll 16.

Although the present invention has been described in connection with the preferred embodiments, it will be apparent to those skilled in this art that various modifications may be made to them without departing from the scope of the appended claims.

What is claimed is:

1. A method of controlling the charging operation of the contact charger of an electrophotographic apparatus including a photosensitive drum and a developing means for charging a toner with a negative voltage, said photosensitive drum and developing means being normally supplied with a negative voltage during printing, the method comprising the steps of:

supplying a negative charging voltage of a specified level to said contact charger for a first interval defined as at least one initial rotation of said photosensitive drum during warm-up with said developing means not being supplied with a voltage;

cutting off said negative charging voltage; and supplying a negative developing bias voltage which is lower than the surface voltage of said photosensitive drum to said developing means for a second interval defined as the interval before the stopping of the rotation of said photosensitive drum after said first interval, whereby negatively charged toner particles scattered by said developing means and abnormally attached to said photosensitive drum are moved from said photosensitive drum to said developing means owing to the electrical potential difference between the surface of said photosensitive drum and said developing means in said first interval, and positively charged toner particles are moved from said contact charger to said photosensitive drum then to said developing means owing to said negative developing bias voltage in said second interval.

2. The method as defined in claim 1, said second interval being further defined as the time taken for at least one complete rotation of said contact charger when said contact charger comprises a conductive roll.

3. A method of controlling the charging operation of the contact charger of an electrophotographic apparatus including a photosensitive drum and a developing means for charging a toner with a negative voltage, said photosensitive drum and developing means being normally supplied with a negative voltage during printing, the method comprising the steps of:

supplying a negative charging voltage of a specified level to said contact charger for a first interval defined as at least one complete initial rotation of said photosensitive drum before and after a printing operation with said developing means not being supplied with a voltage;

cutting off said negative charging voltage; and supplying a negative developing bias voltage which is lower than the surface voltage of said photosensitive drum to said developing means for a second interval defined as the interval before the stopping of the rotation of said photosensitive drum after said first interval, whereby negatively charged toner particles scattered by said developing means and abnormally attached to said photosensitive drum are moved from said photosensitive drum to said developing means owing to the electrical potential difference between the surface of said photosensitive drum and said developing means in said first interval, and positively charged toner particles are moved from said contact charger to said photosensitive drum and then to said developing means owing to said negative developing bias voltage in said second interval.

4. The method as defined in claim 3, said second interval being further defined as the time taken for at least one complete rotation of said contact charger when said contact charger comprises a conductive roll.

5. A method of controlling the charging operation of the contact charger of an electrophotographic apparatus including a photosensitive drum and a developing means for charging a toner with a negative voltage, said photosensitive drum and developing means being normally supplied with a negative voltage during printing, the method comprising the steps of:

supplying a negative charging voltage of a specified level to said contact charger for a first interval defined as at least one initial rotation of said photosensitive drum during warm-up with said developing means not being supplied with a voltage;

cutting off said negative charging voltage;

uniformly exposing the whole surface of said photosensitive drum to light so as to raise the electrical potential thereof; and supplying a negative developing bias voltage which is lower than the surface voltage of said photosensitive drum to said developing means for a second interval defined as the interval before the stopping of the rotation of said photosensitive drum after said first interval, whereby negatively charged toner particles scattered by said developing means and abnormally attached to said photosensitive drum are moved from said photosensitive drum to said developing means owing to the electrical potential difference between the surface of said photosensitive drum and said developing means in said first interval, and positively charged toner particles are moved from said contact charger to said photosensitive drum and then to said developing means owing to said negative developing bias voltage in said second interval.

6. The method as defined in claim 5, said second interval being further defined as the time taken for at least one complete rotation of said contact charger when said contact charger comprises a conductive roll.

7. A method of controlling the charging operation of the contact charger of an electrophotographic apparatus including a photosensitive drum and a developing means for charging a toner with a negative voltage, said photosensitive drum and developing means being normally supplied with a negative voltage during printing, comprising the steps of:

supplying a negative charging voltage of a specified level to said contact charger for a first interval defined as at least one complete initial rotation of said photosensitive drum before and after a printing operation with said developing means not being supplied with a voltage;

cutting off said negative charging voltage;

uniformly exposing the whole surface of said photosensitive drum to light so as to raise the electrical potential thereof; and supplying a negative developing bias voltage which is lower than the surface voltage of said photosensitive drum to said developing means for a second interval defined as the interval before the stopping of the rotation of said photosensitive drum after said first interval, whereby negatively charged toner particles scattered by said developing means and abnormally attached to said photosensitive drum are moved from said photosensitive drum to said developing means owing to the electrical potential difference between the surface of said photosensitive drum and said developing means in said first interval, and positively charged toner particles are moved from said contact charger is to said photosensitive drum and then to said developing means owing to said negative developing bias voltage in said second interval.

8. The method as defined in claim 7, said second interval being further defined as the time taken for at least one complete rotation of said contact charger when said contact charger comprises a conductive roll.

* * * * *